US005433510A

United States Patent [19]

Pestel et al.

[11] Patent Number: 5,433,510

[45] Date of Patent: Jul. 18, 1995

[54] REMOVABLE AND DISMOUNTABLE SEAT SYSTEM FOR STANDING ON A BASE

[75] Inventors: Dominique Pestel, Courbevoie; Lionel Braud, Villenouvelle, both of France

[73] Assignee: Zodiac International, Issy-Les-Moulineaux, France

[21] Appl. No.: 113,792

[22] Filed: Sep. 1, 1993

[30] Foreign Application Priority Data

Sep. 1, 1992 [FR] France ..... 92 10447

[51] Int. Cl.[6] ..... A47C 7/00

[52] U.S. Cl. ..... 297/440.1; 297/195.11; 297/252; 248/429; 248/501

[58] Field of Search ..... 297/440.1, 440.14, 130, 297/195.11, 252, 256.13, 337, 344.1; 114/363, 345; 248/424, 429, 420, 501

[56] References Cited

U.S. PATENT DOCUMENTS

| | | | |
|---|---|---|---|
| 4,766,838 | 8/1988 | Johnson | 297/252 X |
| 4,802,708 | 2/1989 | Vos et al. | 297/252 |
| 5,086,721 | 2/1992 | Burkard | 114/363 X |
| 5,120,103 | 6/1992 | Kave | 297/344.1 X |

FOREIGN PATENT DOCUMENTS

| | | | |
|---|---|---|---|
| 1159350 | 12/1983 | Canada | 297/195.11 |
| 0297920 | 1/1989 | European Pat. Off. . | |
| 2642967 | 3/1978 | Germany . | |

*Primary Examiner*—Laurie K. Cranmer
*Attorney, Agent, or Firm*—Larson and Taylor

[57] ABSTRACT

The seat system comprises:

two housings (7) including respective grooves (9) and secured to said base, the housings extending approximately parallel to each other;

at least two legs (11) each including an elongate shank (15) terminated at each of its two ends by respective angled projections (15, 17), the bottom end ones of said projections (17) of the legs being inserted in the grooves (9) of respective ones of the housings (7) and being retained therein in such a manner that the shanks are upstanding while sloping relative to the vertical;

a device (20) for locking the legs axially in their respective housings;

a seat proper (10) suitable for standing on the angled projections at the top ends of the shanks (15); and a quick-fastening device for fastening the seat proper to the top angled projections of said shanks.

8 Claims, 2 Drawing Sheets

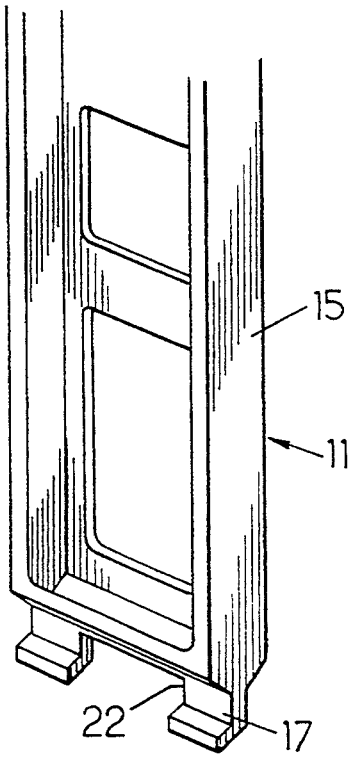
FIG. 3.
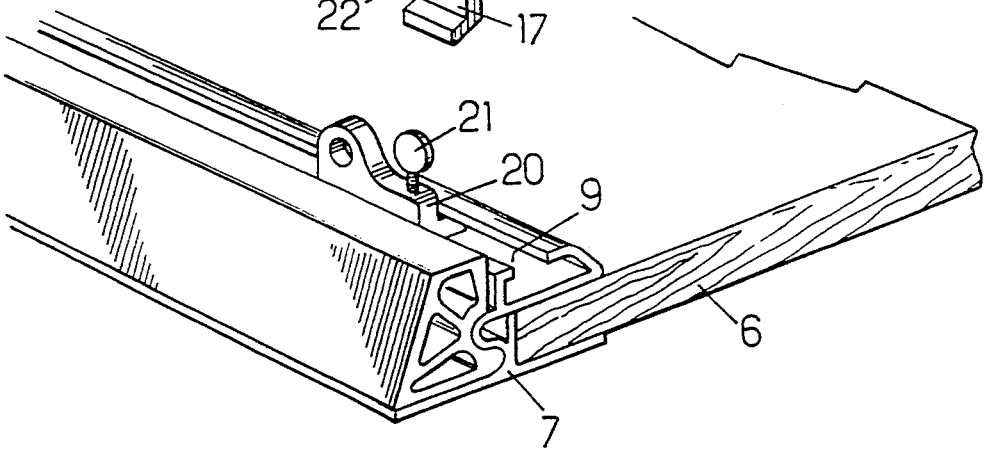
FIG. 4A.
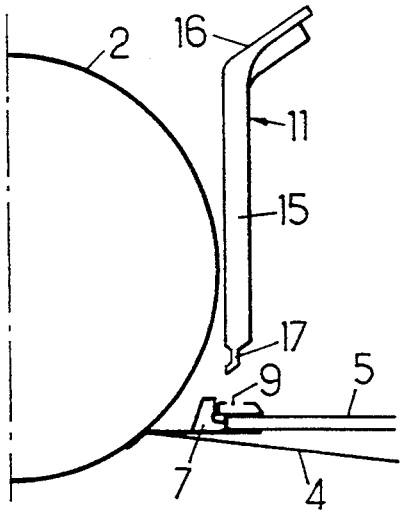
FIG. 4B.
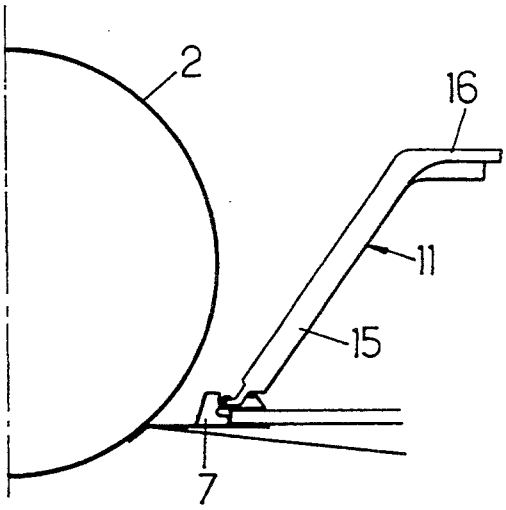

REMOVABLE AND DISMOUNTABLE SEAT SYSTEM FOR STANDING ON A BASE

The present invention relates to a removable and dismountable seat system for standing on a base, and particularly, but not exclusively, to a dismountable thwart for standing on the bottom of water craft, in particular an inflatable dinghy.

A particular object of the invention is to provide such a removable and dismountable seat system which, while being simple in design, stands reliably on its base and preferably with the option of being longitudinally adjusted, while simultaneously being capable of being installed or removed simply and quickly without requiring specialized tooling.

To this end, the present invention provides a removable and dismountable seat system designed to stand on a base, the system being characterized in that it comprises:

- two housings including respective grooves and secured to said base, the housings extending approximately parallel to each other;
- at least two legs each including an elongate shank terminated at each of its two ends by respective angled projections, the bottom end ones of said projections of the legs being inserted in the grooves of respective ones of the housings and being retained therein in such a manner that the shanks are upstanding while sloping relative to the vertical;
- means for locking the legs axially in their respective housings;
- a seat proper suitable for standing on the angled projections at the top ends of the shanks; and
- quick fastening means for fastening the seat proper to the top angled projections of said shanks.

Preferably, the housings are constituted by respective elongate section members secured to the base and disposed substantially parallel to each other.

Advantageously, the upstanding shanks slope towards each other, whereby under drive from a load on the seat proper, they form struts thrust into the grooves.

Thus, once the base has been fitted with the two groove housings (in theory permanently fitted therewith), and in particular with two grooved section members, the seat stands on and is locked to said section members by the shanks acting as struts in the grooves of said section members under the action of the seat weight (the weight of the seat proper plus the weight applied thereto when in use).

The assembly is kept in the proper position solely by the means for connecting the seat proper to the shanks. Thus, by using quick-fastening means, the seat can be installed and removed quickly merely by manipulating said fastening means.

Furthermore, once dismantled, the seat is reduced to parts (seat proper, shanks) that are elongate in shape and that are easily bundled together and stowed.

To ensure that the shanks can be locked quickly but reliably to the corresponding section members, it is advantageous for the axial locking means to comprise, for each leg, at least one shoe that is slidable in the groove of the corresponding section member and that is releasably lockable therein; in which case it is preferable for the axial locking means to comprise, for each leg, a single shoe that is slidable and lockable in the corresponding section member and for each bottom angled projection of the shanks to be fork-shaped so as to straddle said shoe and be retained in the groove on either side of said shoe.

In an advantageous embodiment, the quick-fastening means of the seat proper comprise, for each leg:

- at least one threaded rod secured to the seat proper and projecting from the bottom face thereof;
- at least one hole in the angled projection of the shank through which said threaded rod is to be received; and
- at least one nut screwable onto said threaded rod;

in which case it is advantageous for the seat proper to include a plurality of locations for receiving each threaded rod so as to enable it to be installed on housings that are at different spacings.

A removable and dismountable seat system of the invention is particularly suitable for use in vehicles such as water craft where the bottom or floor is fitted with said housings or section members. In particular, the vehicle may be an inflatable type of dinghy, advantageously a dinghy of the type provided with a floor comprising juxtaposed parallel rigid strips that are held together by the two longitudinal section members that receive the ends of said floor strips, said section members then, in accordance with the invention, being provided with respective longitudinal grooves that are upwardly open for receiving the bottom ends of the shanks of the seat.

The invention will be better understood on reading the following description of a preferred embodiment given solely by way of non-limiting example. In the description, reference is made to the accompanying drawings, in which:

FIG. 3 is an exploded perspective view of another portion of the FIG. 1 seat system; and FIGS. 4A and 4B are simplified views showing two stages in the process of mounting the FIG. 1 seat system.

By way of concrete example, the following description refers to a removable and dismountable seat system for fitting to an inflatable type of water craft, but it should nevertheless be understood that the same system could equally well be installed in other types of craft or in other types of vehicle, or indeed in an environment other than that of a vehicle.

Figure 1:
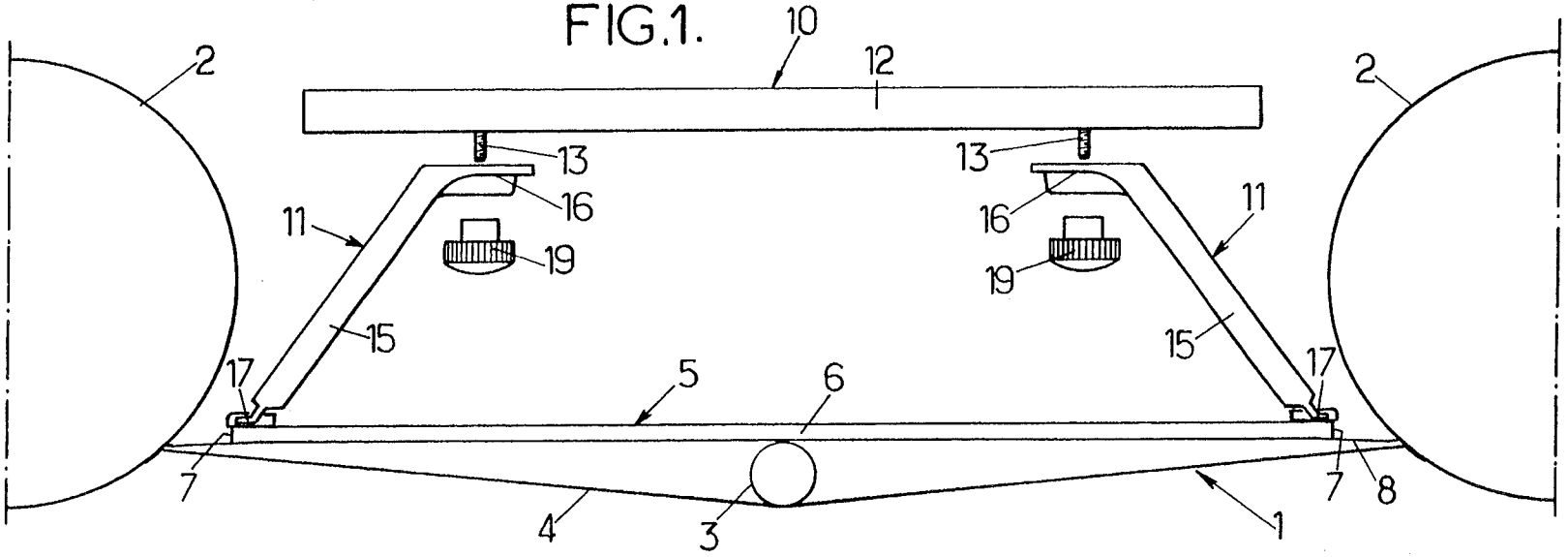
FIG. 1 is a highly diagrammatic exploded view of a preferred embodiment of a removable and dismountable seat system of the invention, as fitted to an inflatable water craft.

In FIG. 1, an inflatable dinghy 1 is represented (in cross-section) by lateral inflatable tubes 2, by a keel-forming central tube 3 over which a bottom sheet 4 is stretched, and a bottom or floor 5 that extends between the two main tubes 2.

In conventional manner, such a floor may be made up of a set of rigid strips or battens (e.g. made of wood) 6 that are assembled together parallel to one another so as to enable the floor to be rolled up when the dinghy is to be transported in the deflated state. To obtain the desired mechanical strength when the dinghy is inflated, the respective ends of the strips 6 are engaged in two parallel rigid section members 7, e.g. made of aluminum, in the form of channel members on their sides that extend laterally in the vicinity of the tubes, as can be seen clearly in FIG. 3. These section members are secured by any appropriate means (glue, screws, rivets, .

. . ) to the bottom sheet 8 that is stretched between the tubes 2 and/or to the tubes themselves.

To constitute the seat system of the invention, each section member 7 is also provided, in particular on its top face, with a groove 9 that is upwardly opened by an opening that is narrower than the bottom of the groove.

Otherwise, the seat essentially comprises legs 11, and a seat proper 12.

Figure 2:
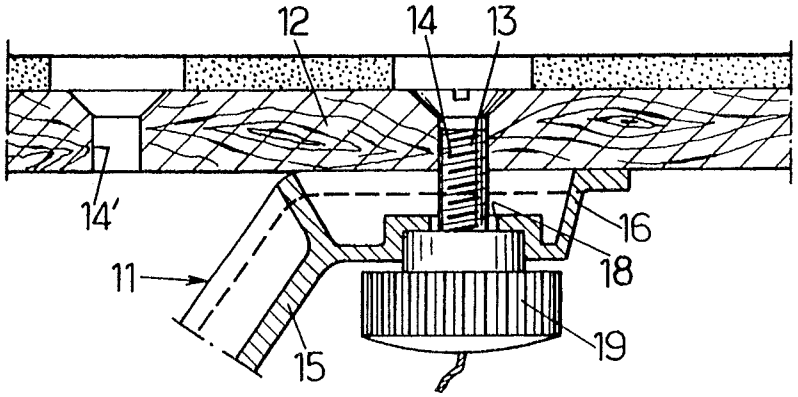
FIG. 2 is a section view through a portion of the FIG. 1 seat system.

As can be seen in FIGS. 1 and 2, the seat proper 10 is generally in the form of a plane or substantially plane rectangular panel or plank 12 which may be implemented in any appropriate manner. Two threaded rods 13 project from the bottom face of said plank 12 and, as shown in FIG. 2, they may advantageously be constituted by two screws that are engaged in two through passages drilled through the plank, near to the ends thereof.

Advantageously, a plurality of passages 14, 14', . . . may be provided at each end of the plank 12 at different mutual spacings so as to enable the plank 12 constituting the seat proper 10 to be installed on legs 11 at different spacings (which may correspond to dinghies of different widths).

Each leg 11 is generally in the form of a very open S-shape essentially comprising an elongate shank 15 terminated at its ends respectively by a top projection 16 and by a bottom projection 17 that extend in opposite directions to each other.

The top angled projection 16 forms a support on which the plank 12 can stand and it has a hole 18 through which the threaded rod 13 of said plank passes. A nut 19 embedded in a knob is screwed onto the threaded rod 13 to enable the plank 12 to be assembled quickly to the leg 11.

The bottom angled projection 17 that faces away from the top angled projection 16 is inserted into the groove 9 of the section member 7 by holding the shank 15 in an approximately vertical position as shown in FIG. 4A, and then by tilting the leg into an inclined position as shown in FIG. 4B so as to lock the projection 17 into the bottom of the groove 9. The shanks 15 then slope towards each other relative to the vertical.

Once the plank 12 has been secured to the legs after they have been installed in the section members, forces acting vertically on the seat proper (e.g. the weight of a seated person) are conveyed to the legs that splay apart and that thus constitute struts thrusting into the section members 7.

Although there may be four legs disposed in pairs and substantially in the four corners of the seat proper 12, it is nevertheless more advantageous to reduce the number of component parts by providing only two legs, each in the form of a wide component for imparting stability, as shown in FIG. 3. These legs may be manufactured, for example, by molding a rigid plastics material or by casting a metal (aluminum).

To lock each leg 11 on the associated section member 7 while still allowing position adjustment to be performed along the section member, sliding shoes 20 are provided that are inserted in the groove 9 and that can be locked by means of a thumbscrew 21. Still for the purpose of reducing the number of component parts, the bottom angled projection 17 may include a middle notch 22 so that it is fork-shaped (see FIG. 3), thereby enabling it when inserted in the groove 9 of the associated section member to straddle a shoe 20 which thus suffices on its own to lock the leg to the section member.

The set of means implemented by the invention thus makes it possible to constitute a seat that is removable and dismountable, that is simple in design, that includes a small number of component parts that are relatively simple, and that does not require any special tooling for installation or removal.

In addition, its design makes it possible for it to be installed on any type of base on which or in which it is possible to provide and/or secure rigid section members for receiving the ends of the legs 11.

Naturally, it is possible for the bottom projections of the legs 11 to be received not only in section members but in simple housings having no longitudinal extent, in which case the edges of these housings themselves constitute the means for locking the legs in place.

Naturally, and as can be seen from the above, the invention is not limited in any way to the particular embodiments and applications described in detail; on the contrary it extends to any variants thereof.

We claim:

1. A removable and dismountable seat system designed to stand on a base, said seat system comprising:

two elongate housings including respective elongate grooves, said housings being securable to said base, said housings being constituted by respective elongate section members securable to the base and disposed substantially parallel to each other;

at least two legs each including an elongate shank terminated at top and bottom ends by respective outwardly angled projections, the bottom end ones of said projections of the legs, in use, being inserted in the grooves of respective ones of the housings and being retained therein in such a manner that the shanks are upstanding while sloping relative to the vertical;

means for locking the legs axially in their respective housings, said means comprising, for each leg, at least one shoe slidable in the groove of the corresponding section member and lockable in releasable manner therein;

a seat proper adapted to be positioned on the angled projections at the top ends of the shanks and being adapted to be fastened thereto; and quick-fastening means for fastening the seat proper to the top angled projections of said shanks.

2. A seat system according to claim 1, wherein, in use, the upstanding shanks of the legs slope inwardly towards each other whereby under drive from a load on the seat proper, they form struts thrust into the grooves.

3. A seat system according to claim 1, wherein for each leg, said at least one shoe is a single shoe that is slidable and lockable in the corresponding section member and wherein each of the bottom angled projections of the shanks is fork-shaped so as to be capable of straddling said shoe and for being retained in the groove on either side of said shoe.

4. A seat system according to claim 1, wherein the quick-fastening means for seat proper comprise, for each leg:

at least one threaded rod secured to the seat proper and projecting from the bottom face thereof;

at least one hole in the angled projection of the shank through which said threaded rod is to be received; and at least one nut screwable onto said threaded rod.

5. A seat system according to claim 4, wherein the seat proper includes a plurality of locations for receiving each threaded rod so as to enable the seat system to be installed on housings that are at different spacings.

6. A vehicle having a floor, in particular a water craft, fitted with a seat system according to claim 1, said housings being secured to the floor of the vehicle.

7. An inflatable water craft having a bottom fitted with a seat system according to claim 1, said housings being secured to the bottom of the craft.

8. An inflatable water craft according to claim 7, said water craft being provided with a floor made up of of juxtaposed parallel rigid strips, the ends of said rigid strips being engaged in respective ones of said elongate section members, said grooves in said housings being upwardly-open longitudinal grooves.

* * * * *